US008001952B2

(12) United States Patent
Dohrmann et al.

(10) Patent No.: US 8,001,952 B2
(45) Date of Patent: Aug. 23, 2011

(54) VIBRATION- AND PULSATION-ATTENUATED ELECTROPNEUMATIC CONVERTER

(75) Inventors: Rolf Dohrmann, Kaarst (DE); Janusz Zurke, Straelen (DE); Alvito Fernandes, Burscheid (DE)

(73) Assignee: Pierburg GmbH, Neuss (DE)

( * ) Notice: Subject to any disclaimer, the term of this patent is extended or adjusted under 35 U.S.C. 154(b) by 331 days.

(21) Appl. No.: 12/377,895

(22) PCT Filed: Aug. 2, 2007

(86) PCT No.: PCT/EP2007/058009
§ 371 (c)(1),
(2), (4) Date: Feb. 18, 2009

(87) PCT Pub. No.: WO2008/019949
PCT Pub. Date: Feb. 21, 2008

(65) Prior Publication Data

US 2010/0163007 A1 Jul. 1, 2010

(30) Foreign Application Priority Data

Aug. 18, 2006 (DE) ..... 10 2006 038 920

(51) Int. Cl.
*F02B 47/08* (2006.01)
*F02B 47/00* (2006.01)

(52) U.S. Cl. ..... 123/568.21

(58) Field of Classification Search ..... 123/568.21, 123/568.26, 389, 393; 251/129.15, 30.1; 137/487.5, 489.5
See application file for complete search history.

(56) References Cited

U.S. PATENT DOCUMENTS

| | | | | |
|---|---|---|---|---|
| 4,579,145 | A | 4/1986 | Leiber et al. | |
| 4,988,074 | A | 1/1991 | Najmolhoda | |
| 5,427,352 | A | 6/1995 | Brehm et al. | |
| 5,547,165 | A | 8/1996 | Brehm et al. | |
| 2006/0145545 | A1 * | 7/2006 | Reichert et al. | 310/14 |

FOREIGN PATENT DOCUMENTS

| | | |
|---|---|---|
| DE | 4110003 | 7/1992 |
| DE | 4205565 | 8/1993 |
| DE | 4329760 | 3/1995 |
| DE | 4332117 | 3/1995 |
| DE | 4342566 | 6/1995 |
| DE | 4404740 | 8/1995 |
| DE | 19755956 | 7/1999 |
| DE | 10327875 | 6/2004 |
| EP | 0683445 | 11/1995 |
| JP | 59183061 | 10/1984 |

OTHER PUBLICATIONS

International Search Report for International No. PCT/EP2007/058009 mailed on Nov. 9, 2007.

* cited by examiner

*Primary Examiner* — Mahmoud Gimie
(74) *Attorney, Agent, or Firm* — Norman B. Thot

(57) ABSTRACT

An electropneumatic converter for connection with an exhaust recirculation valve in a motor vehicle. The electropneumatic converter includes a vacuum port and an atmospheric pressure port configured to connect with a valve chamber using a valve device, wherein a mixed pressure is formed in the valve chamber and supplied to a mixed pressure port. An armature is affixed to a valve body of the valve device movable in an axial direction, the valve body being connected to a suspension device, wherein the armature is displaceable in the axial direction using a solenoid. The electropneumatic converter also includes a damping element configured to dampen the axial movement of the armature and the valve device affixed thereto. The damping element includes at least one of an elastomer or a foamed material.

10 Claims, 5 Drawing Sheets

Fig.1
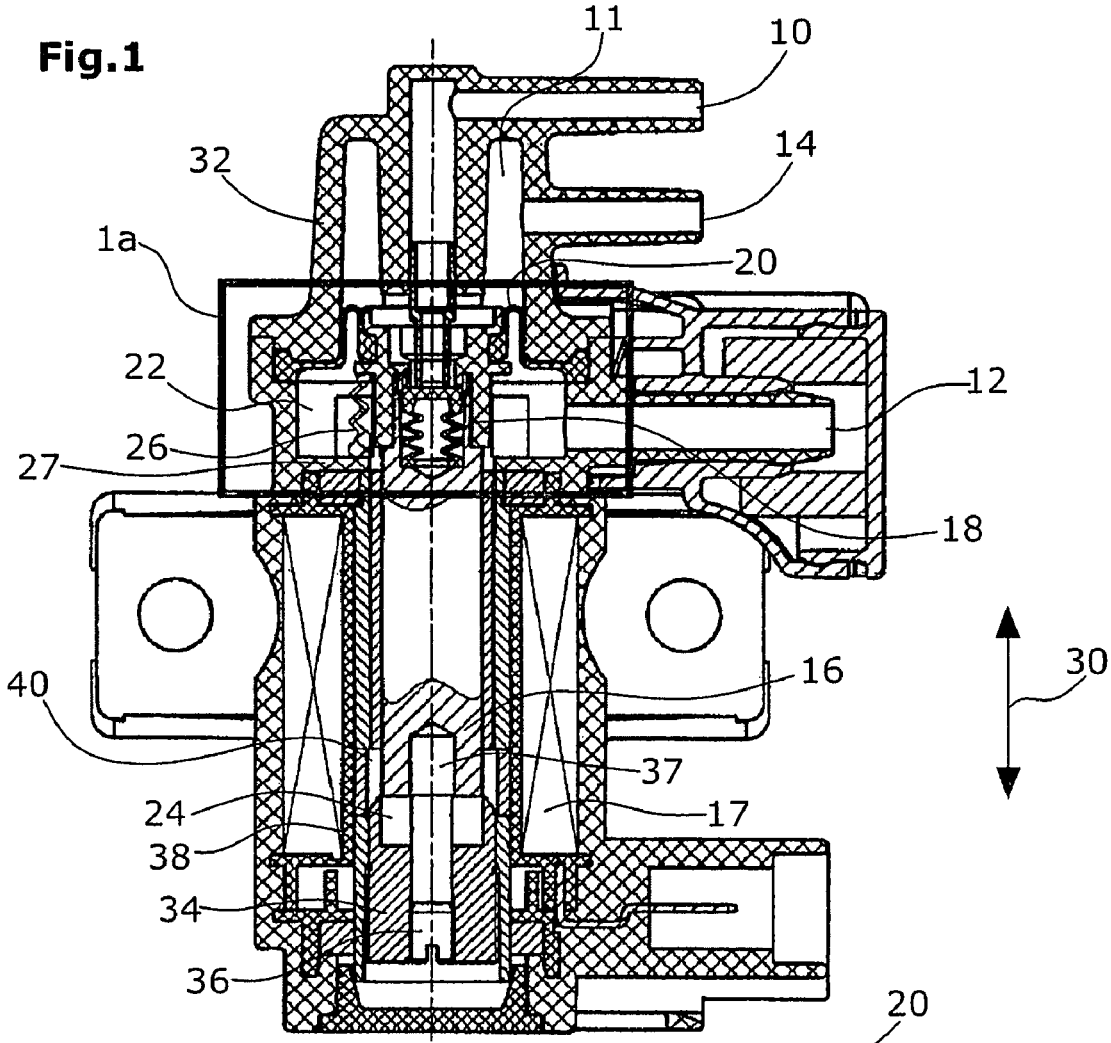
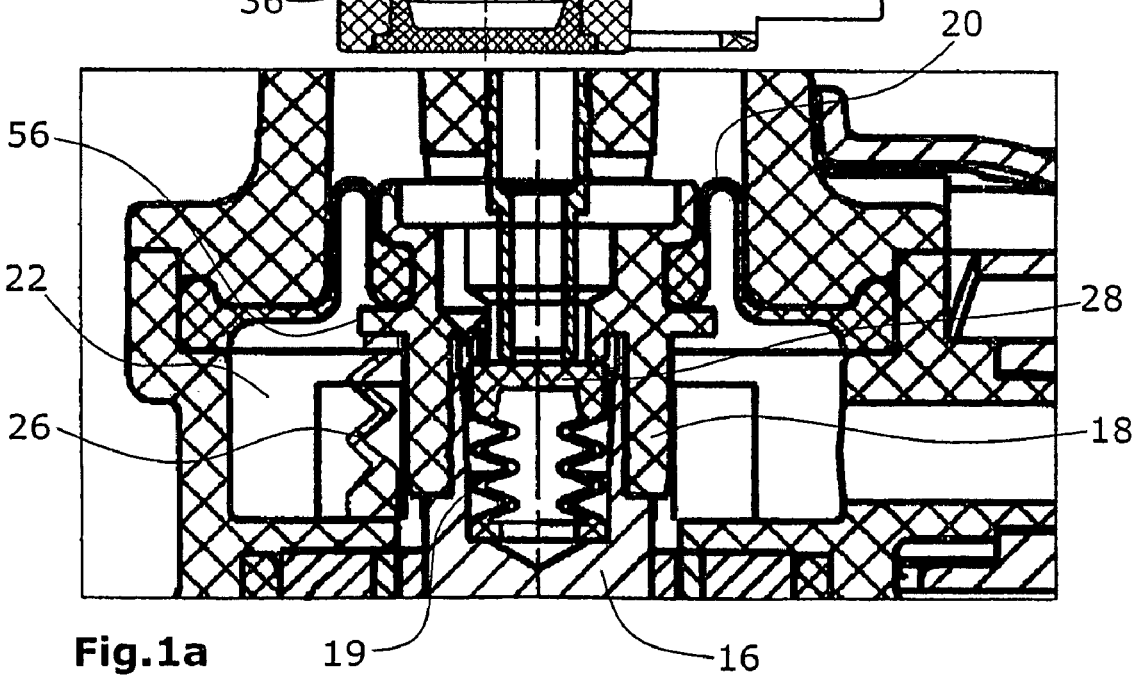
Fig.1a

Fig.2
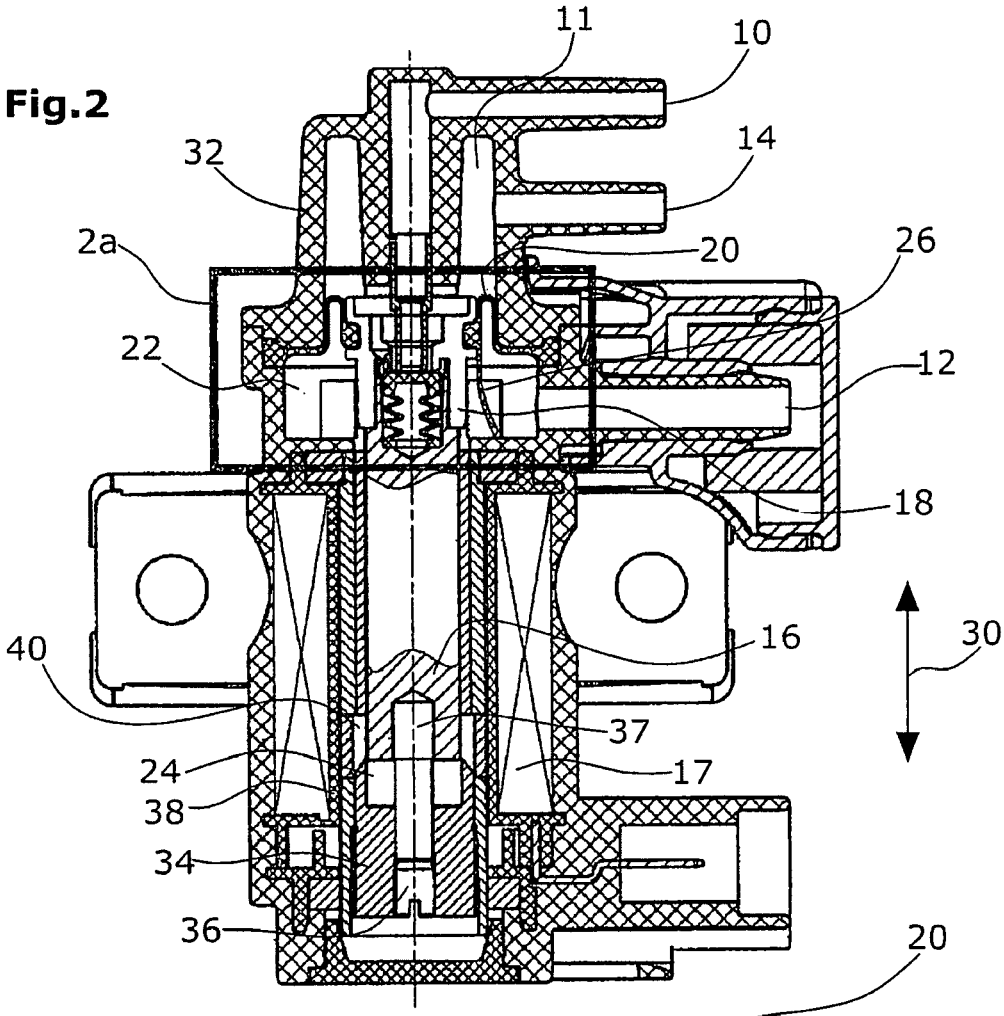
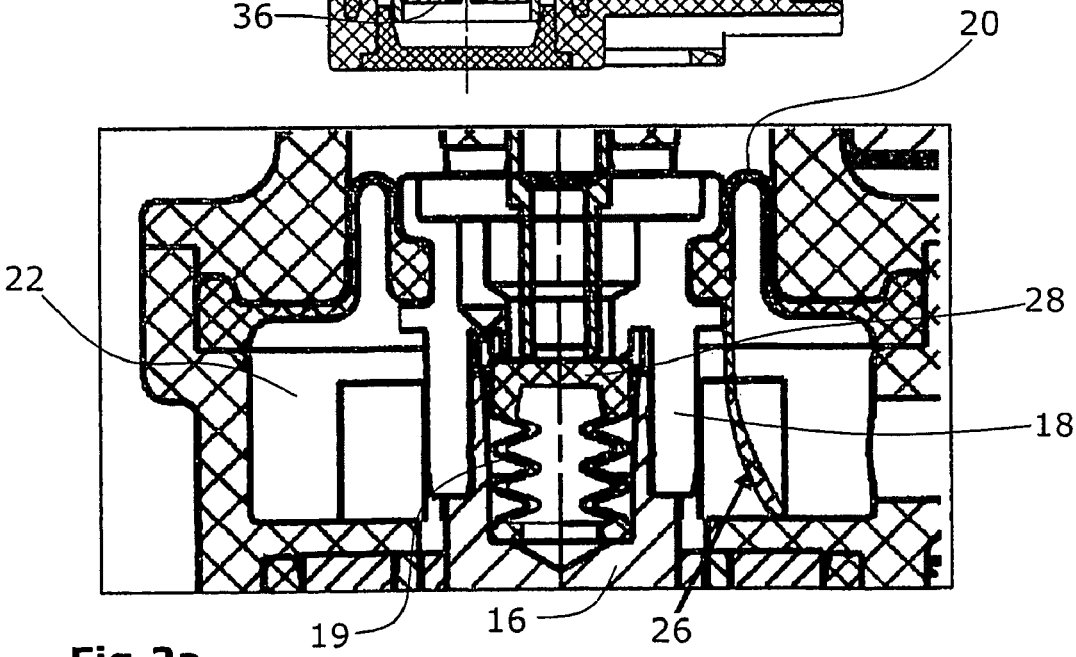
Fig.2a

Fig.3
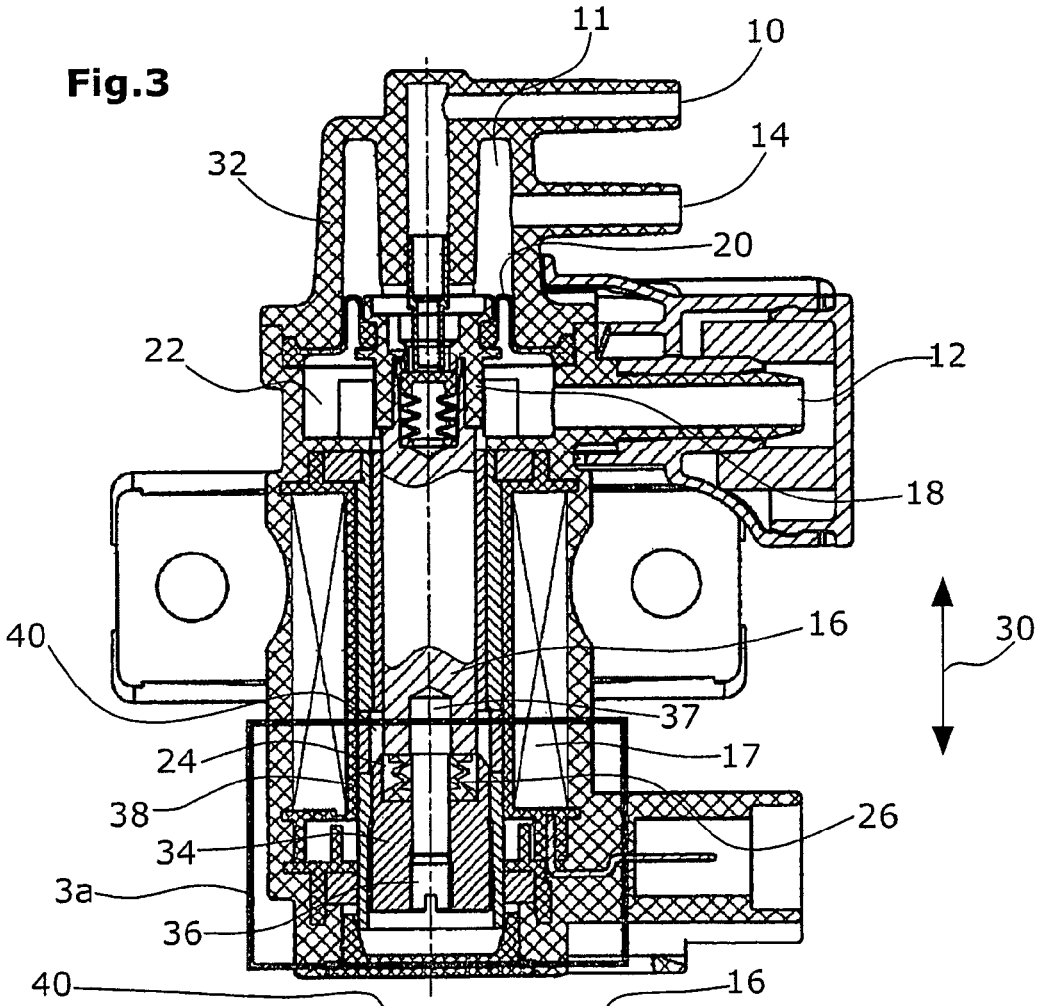
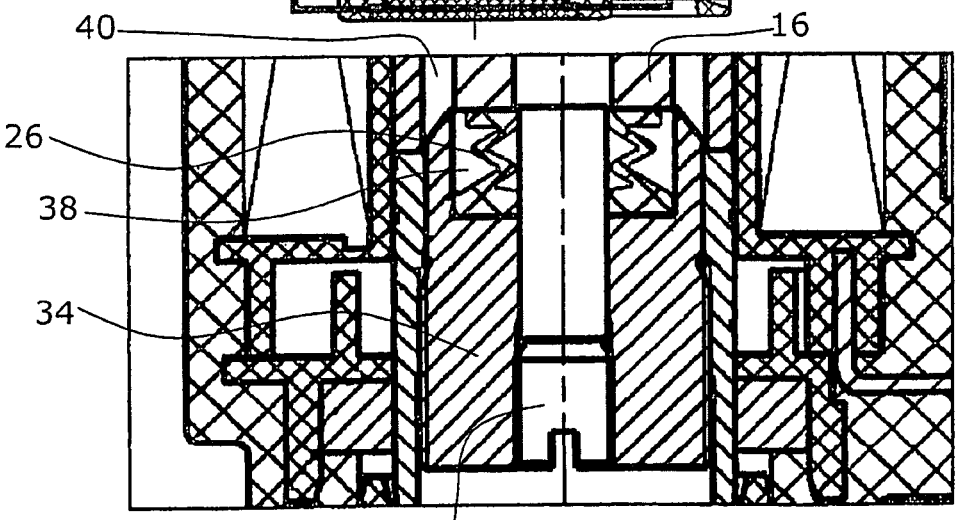
Fig.3a

Fig.4
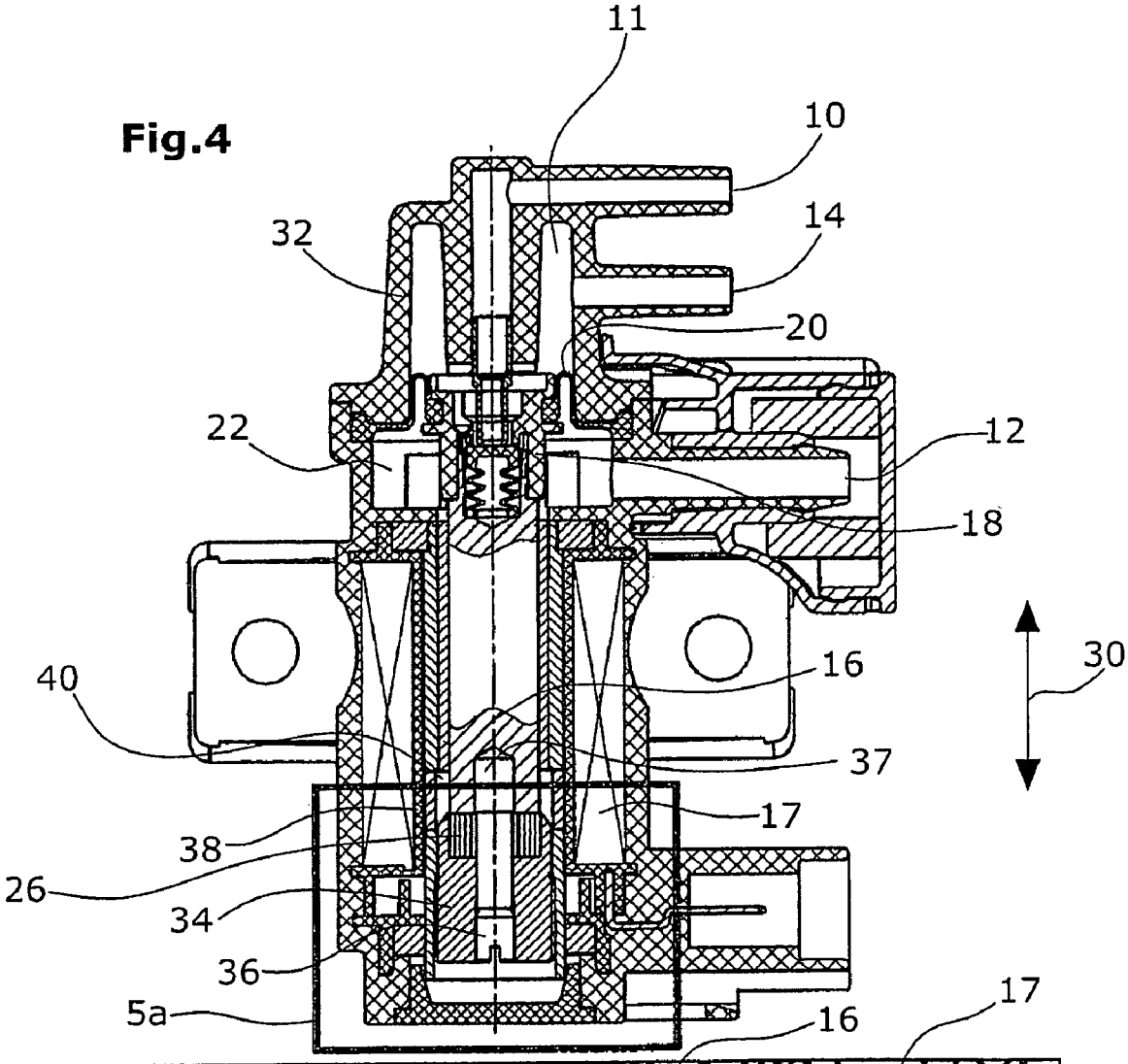
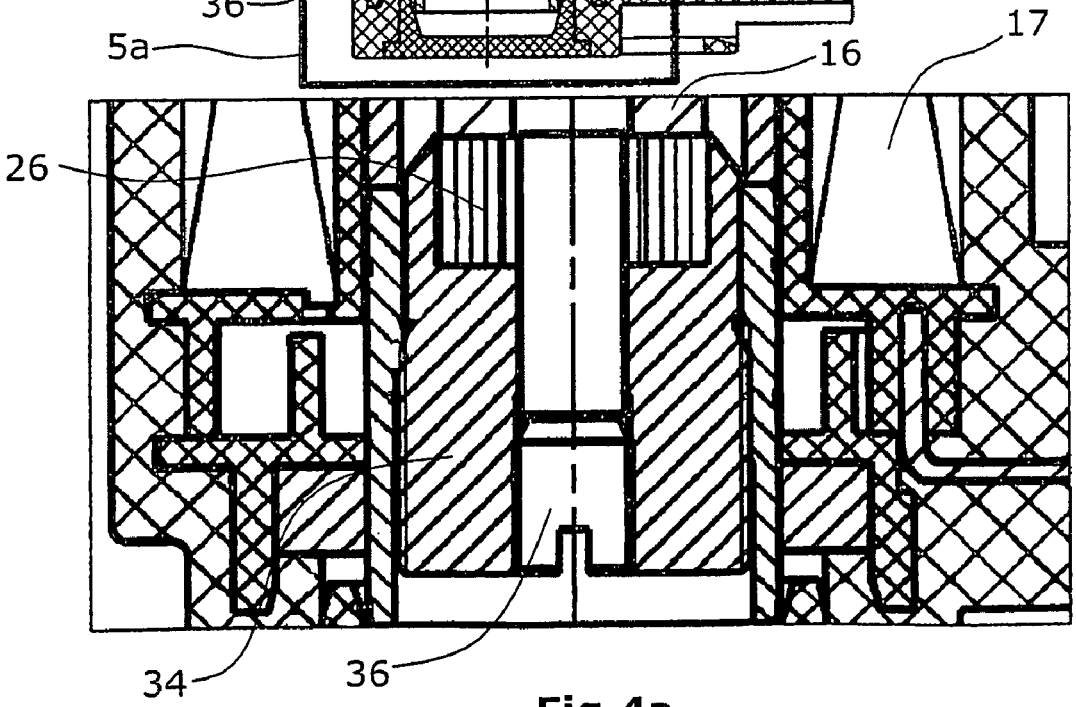
Fig.4a

Fig.5
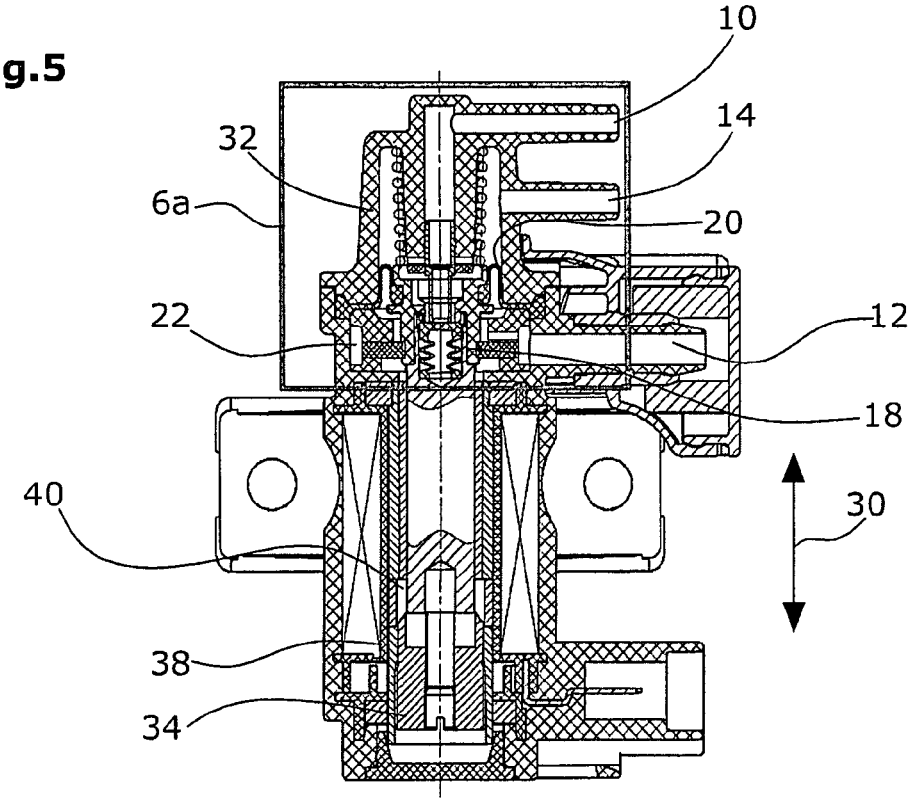
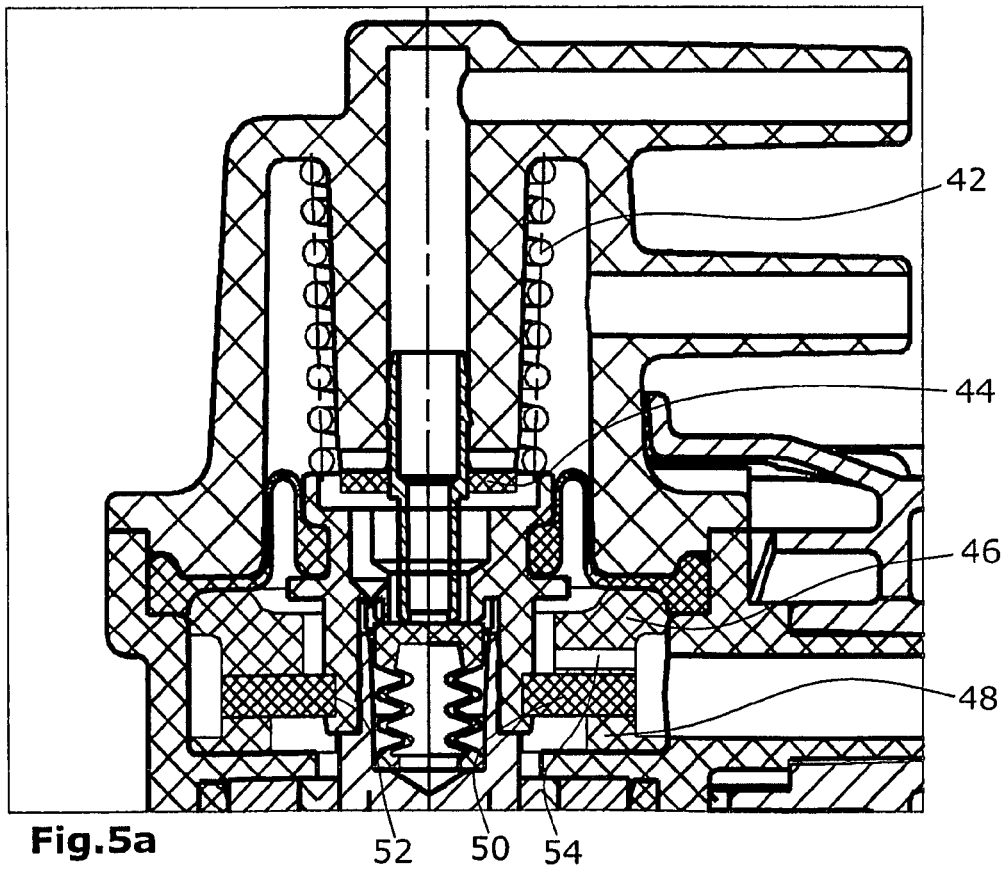
Fig.5a

VIBRATION- AND PULSATION-ATTENUATED ELECTROPNEUMATIC CONVERTER

CROSS REFERENCE TO PRIOR APPLICATIONS

This application is a U.S. National Phase application under 35 U.S.C. §371 of International Application No. PCT/EP2007/058009, filed on Aug. 2, 2007 and which claims benefit to German Patent Application No. 10 2006 038 920.4, filed on Aug. 18, 2006. The International Application was published in German on Feb. 21, 2008 as WO 2008/019949 A1 under PCT Article 21(2).

FIELD

The present invention refers to an electropneumatic converter such as is used, for example, for pneumatic control in motor vehicles, where a mixed pressure is obtained from the intake pressure of an internal combustion engine and atmospheric pressure, said mixed pressure being supplied to a load, such as an exhaust recirculation valve, for example.

BACKGROUND

Such a converter is described, for example, in DE 41 10 003 C1. This converter has three ports, a vacuum being applied to the first port, atmospheric pressure being applied to the second port and a mixed pressure of the first and the second port being applied to the third port which mixed pressure is supplied to a load, such as an exhaust recirculation valve, for example. Moreover, this converter comprises a valve means as well as a plunger-type armature fixedly attached thereto, which is displaceable by means of a solenoid so that the position of the valve means can be changed and the mixed pressure supplied to the load can be controlled. The valve means and the armature attached thereto are suspended from a membrane such that they are movable in the axial direction.

It is a drawback of such a pressure converter that the armature and the valve means can swing freely in the axial direction, whereby undesirable vibrations can be caused especially by engine vibrations or by pressure pulsations on the part of the connected components. This undesirable effect occurs particularly frequently in connection with vacuum pulsations.

Moreover, pulsations can occur in a state in which no current flows through the solenoid and the solenoid can exert no forces on the plunger-type armature and the valve means. Undesirable vibrations of the plunger-type armature and the valve means result in troubles in the operation of the internal combustion engine.

SUMMARY

An aspect of the present invention is to provide an electropneumatic pressure converter that allows for an improved, trouble-free operation of the internal combustion engine.

In an embodiment, the present invention provides an electropneumatic converter for connection with an exhaust recirculation valve in a motor vehicle. The electropneumatic converter includes a vacuum port and an atmospheric pressure port configured to connect with a valve chamber using a valve device, wherein a mixed pressure is formed in the valve chamber and supplied to a mixed pressure port. An armature is affixed to a valve body of the valve device movable in an axial direction, the valve body being connected to a suspension device, wherein the armature is displaceable in the axial direction using a solenoid. The electropneumatic converter also includes a damping element configured to dampen the axial movement of the armature and the valve device affixed thereto. The damping element includes at least one of an elastomer or a foamed material.

BRIEF DESCRIPTION OF THE DRAWINGS

The following is a detailed description of preferred embodiments of the present invention with reference to figures.

In the Figures:

FIGS. 1-5 are sectional views of different embodiments of the electropneumatic converter, and FIGS. 1*a*-5*a* details of the damping elements of the electropneumatic converters illustrated in FIGS. 1-5.

DETAILED DESCRIPTION

For the dampening of the axial movement of the armature and the valve means attached thereto, a damping element is provided. This effectively avoids undesirable axial vibrations of the armature and the valve means attached thereto, so that a trouble-free operation of the internal combustion engine is possible.

In particular, the present invention allows for a reduction of pulsations in a non-energized state as well as in the operational range of the electropneumatic converter. Furthermore, the present invention leads to better large signal behavior and a better small signal behavior of the electropneumatic converter during the venting operation.

The damping element may be located in particular between the valve means and a housing. Further, the damping element may also be situated between the armature and a iron core located beneath the armature.

Moreover, the damping element may be configured, for example, as a membrane.

Independent of the material used, the damping element may be mounted at different positions of the electropneumatic converter, as described above, so that a damping of the axial movement of the armature and the valve means attached thereto becomes possible.

In an embodiment, the damping element can be integrated in the suspension means by which the valve body and the armature attached thereto are suspended so as to be movable in the axial direction. For example, the damping element may be realized by damping legs integrated in the suspension means, whereby the assembly of an additional damping element can be omitted. Further, the damping element may be integrated in other existing components of the electropneumatic converter, i.e., besides their actual function, these components may also have a damping function with respect to the axial movement of the armature and the valve means attached thereto. Using an additional damping element is not required in such an arrangement. In the present context, the term integrated means that the further component and the damping element are formed integrally, the damping element and the further component being two components that are fixedly connected with each other, or the damping element and the further component being a single component of monolithic design.

In an embodiment, the damping element can be arranged at the venting side of the electropneumatic converter to which atmospheric pressure is applied. Thereby, the closing operation of the valve means can be delayed for a short moment, whereby the behavior of the electropneumatic converter is improved especially in the small signal range. Here, the valve plate of the bellows closes the vacuum pipe, which may in particular be configured as a brass pipe, and the venting occurs past the bellows. The force exerted on the armature by the damping element causes a delayed closing of the second valve seat integrated in the armature. The sealing surface of the bellows keeps the vacuum port (vacuum source/pump) closed for as long as possible, so as to allow venting. In particular, such an arrangement causes an improved large signal and small signal behavior upon venting. The atmosphere port should stay open for as long as possible. Thus, for example, a vacuum can be relieved more quickly. When the effective pressure and the force, which is exerted by the solenoid on the armature, are almost at an equilibrium, the valve plane of the bellows closes both valve seats. Now, the further venting takes place via the valve bypass until the final balance of forces has been reached.

In another embodiment, the damping element may be designed as a damping membrane in the form of an elastomeric ring in which the armature is supported.

With reference to FIG. 1, an electropneumatic converter has a vacuum port 10, an atmospheric pressure port 12 and a mixed pressure port 14 to which is applied a mixed pressure of the vacuum port 10 and the atmospheric pressure port 12. The mixed pressure is supplied to a load, in particular an exhaust recirculation valve, via the mixed pressure port 14.

The valve means 18, 28 comprises a valve body 18 with a valve plate 28. The valve body is connected with a housing 32 via a membrane 20 such that it is movable in the axial direction 30. The membrane 20 annularly surrounds the valve body 18 and is fixed in a clamping manner in an annular recess 32 in the housing or a housing cover. Between the valve body 18 and the housing 32 or the housing cover, the membrane 20 follows a substantially arcuate path. At the valve body 18, the membrane 20 is also mounted in a recess that extends annularly around the valve body 18.

An armature 16 is fixedly attached to the valve body 18, the armature also being movable in the axial direction. The armature 16 comprises magnetic material and can be moved by supplying electric current to a solenoid 17.

The electric coil of the solenoid 17 is enclosed by an iron casing 38 to bundle the magnetic field lines. Moreover, an air gap 40 is formed between the armature 16 and the iron casing 38, in which air gap an adjustable iron core 34 is arranged such that the length of the air gap 40 is variable. In addition, a second iron core 36 is provided that protrudes into a recess 37 of the armature 16. A cavity 24 is formed between the first iron core 34 and the armature 16.

The mixed pressure supplied to a load via the mixed pressure port 14 is formed in a valve chamber 11 defined by the membrane 20. The mixed pressure is obtained from the pressure supplied to the solenoid via the vacuum port and the air pressure supplied to the electropneumatic valve via the atmospheric pressure port 12.

By varying the current supplied to the solenoid 17, the mixed pressure supplied to the load can be regulated precisely. An exact adjustment of the air gap 40 is possible by an adjustment of the iron cores 34, 36, so that possible effects of mechanical and/or electromagnetic tolerances can be eliminated.

According to FIGS. 1 and 1*a*, the valve plate 28 is formed monolithically with the elastomeric bellows 19, whereby it is resiliently connected with the armature 16. The vacuum port can be opened and closed by means of the valve plate 28.

An important feature of the electropneumatic converter of the present invention is the damping element 26, designed as a bellows of elastomeric material and arranged between a valve seat collar 56 and the coil rib 27. This bellows serves to effectively avoid undesirable axial vibrations of the armature and the valve means attached thereto, so that a trouble-free operation of the internal combustion engine is possible.

In the following Figures, identical or similar components will be identified by the same reference numerals.

As illustrated in FIGS. 2 and 2*a*, the damping element 26 is formed as a part of the membrane 20 and may be formed integral with the membrane 20 in an injection molding process. In analogy to FIGS. 1 and 1*a*, the effect of the damping element 26 is realized by one side of the element being supported at the coil rib 27 and the opposite side introducing a force into the membrane 20 connected therewith. Here, the damping element 26 is arranged on the venting side of the electropneumatic converter, i.e. on the side that is immediately connected with the atmospheric pressure port 12.

As illustrated in FIGS. 2 and 2*a*, the damping element 26 is also arranged within the cavity 22.

In FIGS. 3 and 3*a*, a damping element 26 of elastomer is illustrated that is arranged within a cavity 24 formed between the armature 16 and the iron core 34.

At the same location, FIGS. 4 and 4*a* show a damping element formed by a foam material member.

In another embodiment according to FIGS. 5 and 5*a*, the damping element may be configured as a damping membrane 50, and in particular as an elastomeric ring, in which the armature 16 is supported. The elastomeric ring can, for example, comprise silicone. As an alternative or in addition, the strokes of the armature 16 and the valve means 18, 28 may be damped by abutments 44, 46, 48 provided on the housing 32. These can, for example, be provided at the location of the housing 32 towards which the valve body 18 moves as it moves in the direction of the force exerted by the membrane 20.

An exact matched positioning of the stroke-preventing or stroke-limiting abutments 44, 46, 48 as well as a matching of the spring force or the membrane force allows to realize an excitation acceleration of 20 g. It is particularly advantageous in this context to use a damping membrane 50 of a thickness between 2 mm and 3 mm, so that limitations to the functions of the electropneumatic converter, such as the characteristic (gradient and hysteresis) or dynamic (large and small signal) can be minimized.

As an alternative or in addition, a thicker damping membrane 30 may also be used, which has recesses that make it more flexible. For receiving the damping membrane 50, the valve body 18 comprises a preferably annular groove 52.

To allow a passage towards the atmospheric pressure port 12, the abutment 46 has a groove-shaped recess 54 through which venting may take place. The abutments 46, 48 can, for example, be made of plastic material.

For an additional damping of the movement of the valve body 18, a spring 42 may be provided between the valve body 18 and the housing 32. According to the present invention, the same is used in combination with further damping elements 26, 50.

Only a single damping element may be provided, for example, only on one side of the armature or the valve means, or a plurality of damping elements may be provided, which are arranged on a plurality of sides of the armature and the valve means.

The invention claimed is:

1. An electropneumatic converter for connection with an exhaust recirculation valve in a motor vehicle, comprising:

a vacuum port and an atmospheric pressure port configured to connect with a valve chamber using a valve device, wherein a mixed pressure is formed in the valve chamber and supplied to a mixed pressure port;

an armature affixed to a valve body of the valve device movable in an axial direction, the valve body being connected to a suspension device, wherein the armature is displaceable in the axial direction using a solenoid; and a damping element disposed outside of the armature and the valve device affixed thereto, the damping element being configured to dampen the axial movement of the armature and the valve device affixed thereto, wherein the damping element includes at least one of an elastomer or a foamed material.

2. The electropneumatic converter recited in claim 1, wherein the at least one of an elastomer or foamed material is polyurethane.

3. The electropneumatic converter recited in claim 1, wherein the damping element is disposed between the valve means and a housing.

4. The electropneumatic converter recited in claim 3, wherein the housing is configured with stroke-limiting abutments to further dampen the axial movement of the armature and the valve means.

5. The electropneumatic converter recited in claim 1, wherein the damping element is disposed between the armature and an iron core.

6. The electropneumatic converter recited in claim 1, wherein the damping element is configured as a membrane.

7. The electropneumatic converter recited in claim 6, wherein the membrane is a rolling membrane.

8. The electropneumatic converter recited in claim 1, wherein the damping element is integrated in the suspension device.

9. The electropneumatic converter recited in claim 1, wherein the damping element is configured as a damping membrane in a form of an elastomer ring supporting the armature.

10. The electropneumatic converter recited in claim 1, wherein an air gap is formed between the armature and an iron casing of the solenoid on a side of the armature opposite the valve means, wherein at least one adjustable iron core is configured to adjust the air gap.

* * * * *